US007762763B2

(12) United States Patent
Stones

(10) Patent No.: US 7,762,763 B2
(45) Date of Patent: Jul. 27, 2010

(54) VACUUM PUMP

(75) Inventor: Ian David Stones, Burgess Hill (GB)

(73) Assignee: Edwards Limited, Crawley, West Sussex (GB)

( * ) Notice: Subject to any disclaimer, the term of this patent is extended or adjusted under 35 U.S.C. 154(b) by 1126 days.

(21) Appl. No.: 10/572,892

(22) PCT Filed: Sep. 23, 2004

(86) PCT No.: PCT/GB2004/004131

§ 371 (c)(1),
(2), (4) Date: Mar. 20, 2006

(87) PCT Pub. No.: WO2005/033522

PCT Pub. Date: Apr. 14, 2005

(65) Prior Publication Data

US 2007/0020116 A1 Jan. 25, 2007

(30) Foreign Application Priority Data

Sep. 30, 2003 (GB) ..... 0322889.7

(51) Int. Cl.
*F01D 3/02* (2006.01)

(52) U.S. Cl. ..... 415/90; 415/99; 415/100; 415/144; 416/175; 416/198 A

(58) Field of Classification Search ..... 415/90, 415/93, 99, 100, 116, 144, 199.5, 211.5, 415/211.2; 416/175, 198 A, 198 R
See application file for complete search history.

(56) References Cited

U.S. PATENT DOCUMENTS 1,073,895 A * 9/1913 Fritz ..... 415/93
1,287,020 A * 12/1918 Hinsch ..... 415/99
1,912,452 A * 6/1933 Hollander ..... 415/100
2,562,996 A * 8/1951 Winthrop ..... 55/470
2,668,501 A * 2/1954 Lutz ..... 415/100
3,666,374 A 5/1972 Becker (Continued)

FOREIGN PATENT DOCUMENTS

DE 100 04 271 A1 8/2001

(Continued)

OTHER PUBLICATIONS

DT 1 950 328 A, Apr. 1, 1971, Siemens AG.

(Continued)

*Primary Examiner*—Edward Look
*Assistant Examiner*—Aaron R Eastman

(57) ABSTRACT

A vacuum pump (100) comprises a first set (106) of turbo-molecular stages, a molecular drag stage (112), a first inlet (120) through which fluid can pass through the first set (106) of stages and the molecular drag stage (112) towards a pump outlet (116), second and third sets (108, 110) of turbo-molecular stages located between the first set (106) and the molecular drag stage (112), a second inlet (122), the second and third sets (108, 110) being arranged such that fluid entering the pump through the second inlet (122) is separated into two streams each flowing through a respective one of the second and third sets (108, 110), and conduit means (126) for conveying fluid passing through the first set (106) and one of the second and third sets (108, 110) towards the outlet (116).

31 Claims, 4 Drawing Sheets

U.S. PATENT DOCUMENTS

| | | | | |
|---|---|---|---|---|
| 3,668,393 | A * | 6/1972 | Von Rauch | 250/441.11 |
| 4,889,995 | A * | 12/1989 | Tsutsumi et al. | 250/440.11 |
| 4,919,599 | A | 4/1990 | Reich et al. | |
| 5,228,838 | A * | 7/1993 | Gebele et al. | 417/53 |
| 5,585,548 | A | 12/1996 | Grosse Bley et al. | |
| 6,050,782 | A | 4/2000 | Lembke | |
| 2002/0136643 | A1 | 9/2002 | Eberl | |
| 2004/0013514 | A1 * | 1/2004 | Englander | 415/90 |
| 2008/0063541 | A1 * | 3/2008 | Stones | 417/250 |

FOREIGN PATENT DOCUMENTS

| | | | |
|---|---|---|---|
| EP | 0 603 694 | A1 | 6/1994 |
| EP | 1 234 982 | A1 | 8/2002 |
| GB | 223 451 | A | 10/1924 |
| WO | WO 01/57402 | A1 | 8/2001 |

OTHER PUBLICATIONS

United Kingdom Search Report of Application No. GB 0322889.7; Claims searched: 10; Date of Search: Jun. 23, 2004.

United Kingdom Search Report of Application No. GB 0322889.7; Claims searched: 11; Date of Search: Jun. 23, 2004.

United Kingdom Search Report of Application No. GB 0322889.7; Date of Search: Mar. 22, 2004.

PCT International Search Report of International Application No. PCT/GB2004/004131; Date of mailing of the International Search Report: Jan. 18, 2005.

Written Opinion of the International Searching Authority of International Application No. PCT/GB2004/004131; Date of mailing: Jan. 18, 2005.

* cited by examiner

VACUUM PUMP

FIELD OF THE INVENTION

This invention relates to a vacuum pump and in particular a compound vacuum pump with multiple ports suitable for differential pumping of multiple chambers.

BACKGROUND OF THE INVENTION

In a differentially pumped mass spectrometer system a sample and carrier gas are introduced to a mass analyser for analysis. One such example is given in FIG. 1. With reference to FIG. 1, in such a system there exists a high vacuum chamber 10 immediately following first and second evacuated interface chambers 12, 14. The first interface chamber 12 is the highest-pressure chamber in the evacuated spectrometer system and may contain an orifice or capillary through which ions are drawn from an ion source into the first interface chamber 12, and ion optics for guiding ions from the ion source into the second interface chamber 14. The second, middle chamber 14 may include additional ion optics for guiding ions from the first interface chamber 12 into the high vacuum chamber 10. In this example, in use, the first interface chamber is at a pressure of around 1 mbar, the second interface chamber is at a pressure of around $10^{-3}$ mbar, and the high vacuum chamber is at a pressure of around $10^{-5}$ mbar.

The high vacuum chamber 10 and second interface chamber 14 can be evacuated by means of a compound vacuum pump 16. In this example, the vacuum pump has two pumping sections in the form of two sets 18, 20 of turbo-molecular stages, and a third pumping section in the form of a Holweck drag mechanism 22; an alternative form of drag mechanism, such as a Siegbahn or Gaede mechanism, could be used instead. Each set 18, 20 of turbo-molecular stages comprises a number (three shown in FIG. 1, although any suitable number could be provided) of rotor 19*a*, 21*a* and stator 19*b*, 21*b* blade pairs of known angled construction. The Holweck mechanism 22 includes a number (two shown in FIG. 1 although any suitable number could be provided) of rotating cylinders 23*a* and corresponding annular stators 23*b* and helical channels in a manner known per se.

In this example, a first pump inlet 24 is connected to the high vacuum chamber 10, and fluid pumped through the inlet 24 passes through both sets 18, 20 of turbo-molecular stages in sequence and the Holweck mechanism 22 and exits the pump via outlet 30. A second pump inlet 26 is connected to the second interface chamber 14, and fluid pumped through the inlet 26 passes through set 20 of turbo-molecular stages and the Holweck mechanism 22 and exits the pump via outlet 30. In this example, the first interface chamber 12 is connected to a backing pump 32, which also pumps fluid from the outlet 30 of the compound vacuum pump 16. As fluid entering each pump inlet passes through a respective different number of stages before exiting from the pump, the pump 16 is able to provide the required vacuum levels in the chambers 10, 14.

In order to increase system performance, it is desirable to increase the mass flow rate of the sample and carrier gas from the source into the high vacuum chamber 10, whilst maintaining the desired pressure in the second interface chamber 14. For the pump illustrated in FIG. 1, this could be achieved by increasing the capacity of the compound vacuum pump 16 by increasing the diameter of the rotors 21*a* and stators 21*b* of set 20. For example, in order to double the capacity of the pump 16, the area of the rotors 21*a* and stators 21*b* would be required to double in size. In addition to increasing the overall size of the pump 16, and thus the overall size of the mass spectrometer system, the pump 16 would become more difficult to drive in view of the increased mass acting on the drive shaft due to the larger rotors and stators of set 20.

BRIEF SUMMARY OF THE INVENTION

It is an aim of at least the preferred embodiment of the present invention to provide a differential pumping, multi port, compound vacuum pump, which can enable the mass flow rate in a differentially pumped vacuum system to be increased specifically where required without significantly increasing the size of the pump.

In a first aspect, the present invention provides a vacuum pump comprising a first pumping section, a first pump inlet through which fluid can enter the pump and pass through the first pumping section towards a pump outlet, second and third pumping sections, a second pump inlet through which fluid can enter the pump, the second and third pumping sections being arranged such that fluid entering the pump through the second inlet is separated into a first stream passing through the second pumping section towards the pump outlet and a second stream passing through the third pumping section away from the pump outlet, means for conveying fluid passing through the third pumping section towards the outlet, and at least one additional pumping section downstream from the first, second and third pumping sections for receiving fluid therefrom and outputting fluid towards the outlet.

By effectively replacing the second pumping section 20 of the known pump by two pumping sections, one on either side of the second inlet and with blade angles generally reversed, fluid entering the pump through the second inlet can be split into two streams flowing in different directions. One stream passes through the second section in the direction of the outlet, whilst the other stream passes through the third section away from the outlet (and thus against the usual flow direction) to conveying means, which conveys that stream towards the outlet. This can enable, for example, the mass flow rate at the second inlet, where required, to be effectively doubled in comparison to the pump illustrated in FIG. 1 for an increase in pump size/length of only around 25-30%.

Minimising the increase in pump size/length whilst increasing the system performance where required can make the pump particular suitable for use as a compound pump for use in differentially pumping multiple chambers of, for example, a bench-top mass spectrometer system requiring a greater mass flow rate at, for example, the middle chamber to increase the flow rate into the analyser with a minimal increase in pump size.

In one arrangement, the conveying means is arranged to convey fluid passing through the third pumping section to a location intermediate the second pumping section and said at least one additional pumping section. Thus, fluid passing through the second pumping section can be combined with the fluid passing through the third pumping section upstream of the outlet. This can enable the fluid passing through the third pumping section against the usual flow direction to be connected to a similar vacuum point as the fluid passing through the intermediate pumping section 20 in the pump illustrated in FIG. 1.

In the preferred embodiments, the second and third pumping sections are located between the first pumping section and said at least one additional pumping section. In such embodiments, the above-mentioned conveying means would additionally convey fluid passing through the first pumping section to a location intermediate the second pumping section and said at least one additional pumping section.

In an alternative arrangement of the conveying means, the conveying means comprises a first conduit for conveying fluid passing through the first pumping section to a position intermediate the second and third pumping sections, and a second conduit for conveying fluid passing through the third pumping section to a location intermediate the second pumping section and said at least one additional pumping section. This can also enable the fluid passing through the first pumping section to be connected to a similar vacuum point as the fluid passing through the pumping section 18 in the pump illustrated in FIG. 1. Preferably, the pump comprises baffle means for directing fluid passing through the first pumping section and the third pumping section to a respective said conduit.

Each of the pumping sections preferably comprises a dry pumping section. Said at least one additional pumping section preferably comprises at least one molecular drag stage, such as a Holweck stage, and/or a regenerative pumping stage, downstream from the first to third pumping sections for receiving fluid therefrom and outputting fluid towards the outlet. Preferably, each of the first to third pumping sections comprises a set of turbo-molecular stages. Preferably, each of these pumping sections comprises at least three turbo-molecular stages. The second and third pumping sections may comprise a similar number of stages, or, alternatively, the second pumping section may comprise a greater number of stages than the third pumping section, in order to overcome any conductance losses in the conduit means. The first pumping section may be of a different size/diameter than the second and third pumping sections. This can offer selective pumping performance.

The pump preferably comprises a drive shaft having mounted thereon at least one rotor element for each of the various pumping sections. The rotor elements for at least some of the turbo-molecular stages may be located on a common impeller mounted on the drive shaft. The molecular drag stage may comprise a Holweck stage comprising at least one rotating cylinder mounted for rotary movement with the rotor elements of the turbo-molecular stages. The cylinder may be mounted on a disc located on the drive shaft, which is preferably integral with the impeller.

The invention also provides a differentially pumped vacuum system comprising two chambers and a pump as aforementioned for evacuating each of the chambers. This system may be a mass spectrometer system, a coating system, or other form of system comprising a plurality of differentially pumped chambers.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
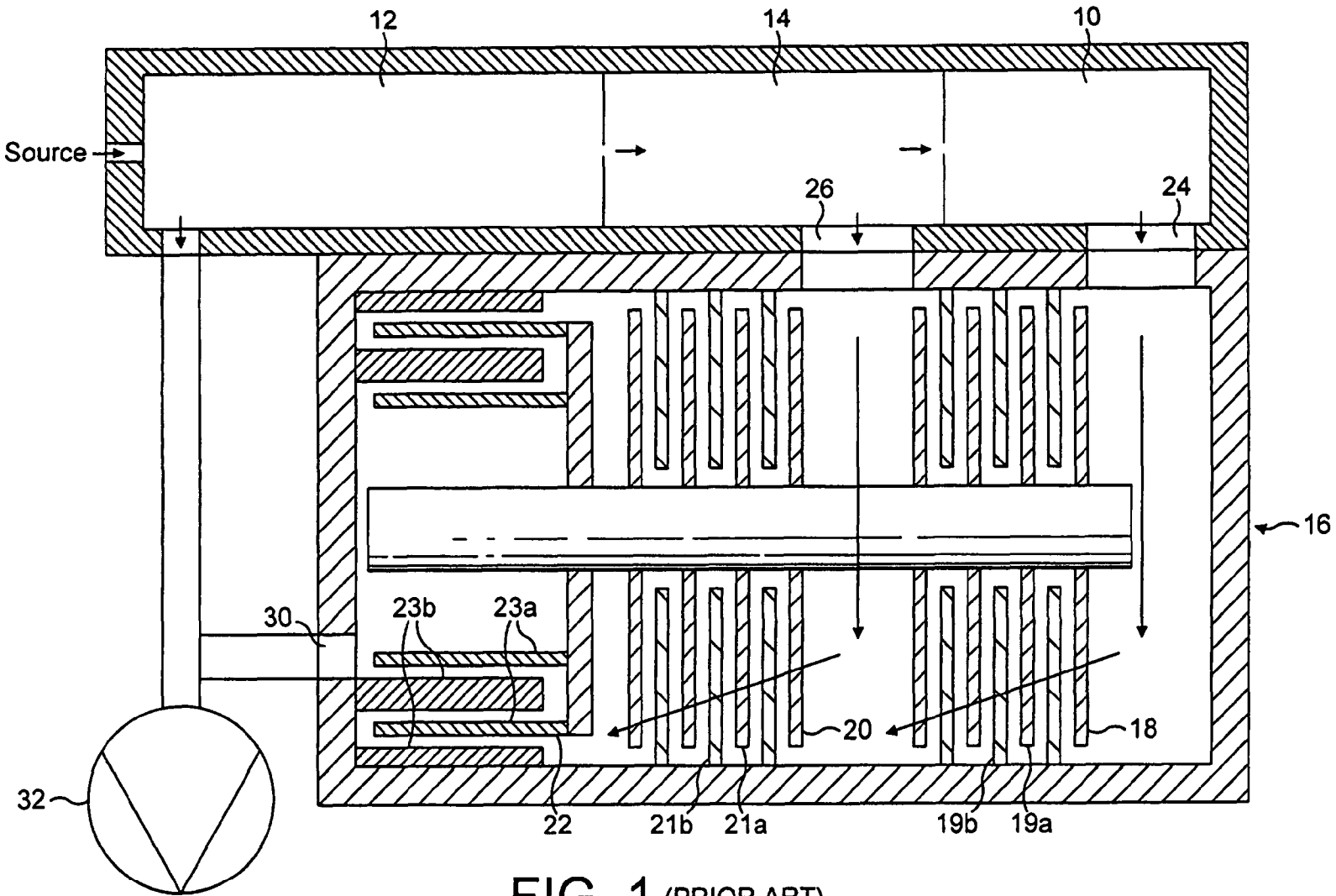
FIG. 1 (PRIOR ART)
FIG. 1 is a simplified cross-section through a known multi port vacuum pump suitable for evacuating a differentially pumped, mass spectrometer system.
Figure 2:
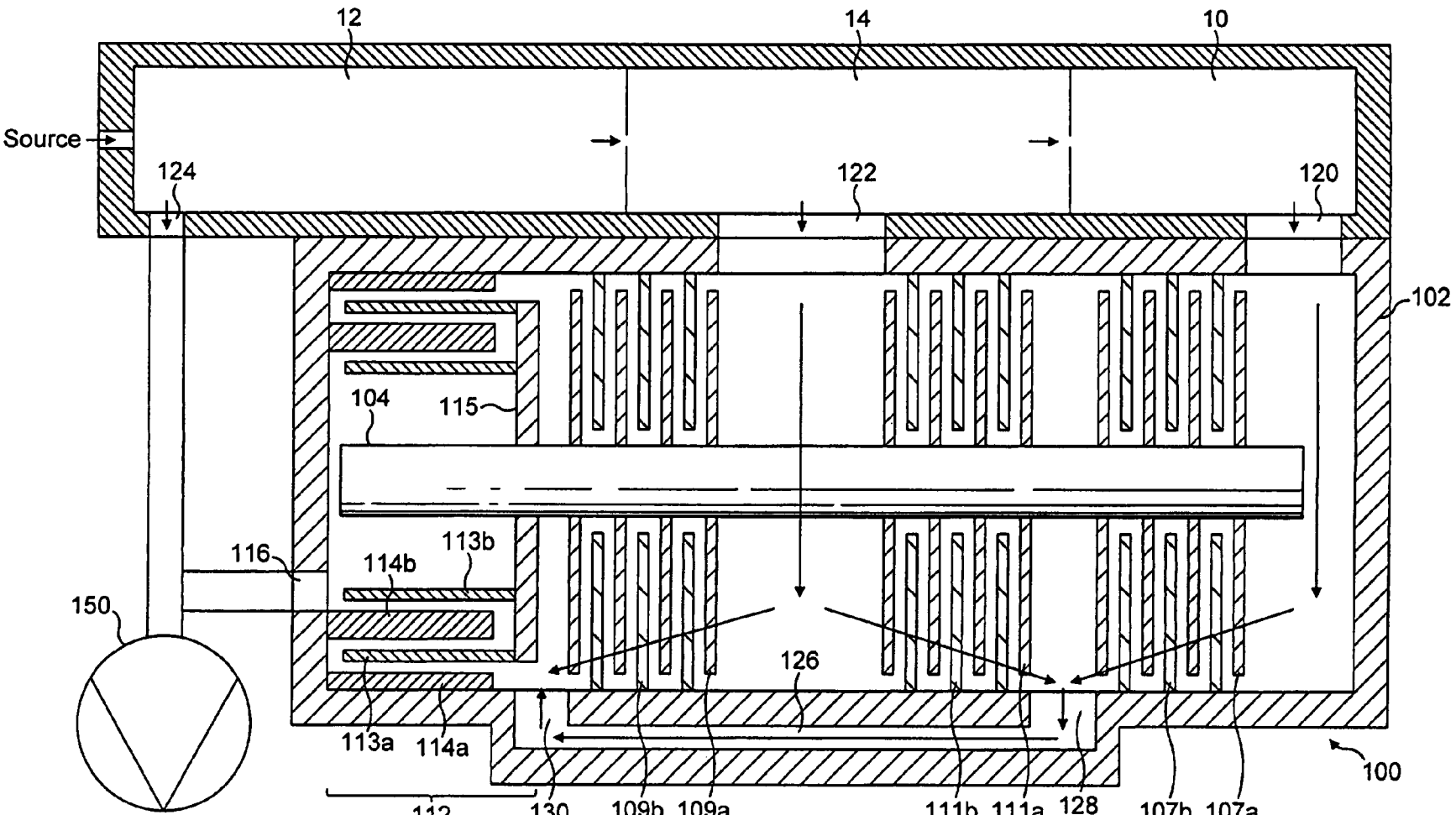
FIG. 2 is a simplified cross-section through a first embodiment of a multi port vacuum pump suitable for evacuating the differentially pumped mass spectrometer system of FIG. 1.

With reference to FIG. 2, a first embodiment of a vacuum pump 100 suitable for evacuating at least the high vacuum chamber 10 and intermediate chamber 14 of the differentially pumped mass spectrometer system described above with reference to FIG. 1 comprises a multi-component body 102 within which is mounted a shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

The pump includes at least four pumping sections 106, 108, 110 and 112. The first pumping section 106 comprises a set of turbo-molecular stages. In the embodiment shown in FIG. 2, the set of turbo-molecular stages 106 comprises four rotor blades and three stator blades of known angled construction. A rotor blade is indicated at 107*a* and a stator blade is indicated at 107*b*. In this example, the rotor blades 107*a* are mounted on the drive shaft 104.

The second pumping section 108 is similar to the first pumping section 106, and also comprises a set of turbo-molecular stages. In the embodiment shown in FIG. 2, the set of turbo-molecular stages 108 also comprises four rotor blades and three stator blades of known angled construction. A rotor blade is indicated at 109*a* and a stator blade is indicated at 109*b*. In this example, the rotor blades 109*a* are also mounted on the drive shaft 104.

The third pumping section 110 also comprises a set of turbo-molecular stages, with blade angles generally reversed in relation to those of the second pumping section 108. In the embodiment shown in FIG. 2, the third pumping section 110 contains the same number of stages as the second pumping section 108, that is, the set of turbo-molecular stages 110 also comprises four rotor blades and three stator blades of known angled construction. A rotor blade is indicated at 111*a* and a stator blade is indicated at 111*b*. In this example, the rotor blades 111*a* are also mounted on the drive shaft 104.

As shown in FIG. 2, downstream of the first to third pumping sections is a fourth pumping section 112 in the form of a Holweck or other type of drag mechanism. In this embodiment, the Holweck mechanism comprises two rotating cylinders 113*a*, 113*b* and corresponding annular stators 114*a*, 114*b* having helical channels formed therein in a manner known per se. The rotating cylinders 113*a*, 113*b* are preferably formed from a carbon fibre material, and are mounted on a disc 115 that is located on the drive shaft 104. In this example, the disc 115 is also mounted on the drive shaft 104. Downstream of the Holweck mechanism 112 is a pump outlet 116.

As illustrated in FIG. 2, the pump 100 has two inlets; although only two inlets are used in this embodiment, the pump may have three or more inlets, which can be selectively opened and closed and can, for example, make the use of internal baffles to guide different flow streams to particular portions of a mechanism. For example, an inlet may be located interstage the second pumping section 108 and the fourth pumping section 112.

In this embodiment, a first, low fluid pressure inlet 120 is located upstream of all of the pumping sections. A second, high fluid pressure inlet 122 is located interstage the second pumping section 108 and the third pumping section 110. A conduit 126 has an inlet 128 located interstage the first pumping section 106 and the third pumping section 110, and an outlet 130 located interstage the second pumping section 108 and the fourth pumping section 112.

In use, each inlet is connected to a respective chamber of the differentially pumped mass spectrometer system. Fluid passing through the first inlet 120 from the low pressure chamber 10 passes through the pumping section 106, enters the conduit 126 at conduit inlet 128, passes out of the conduit 126 via conduit outlet 130, passes through the fourth pumping section 112 and exits the pump 100 via pump outlet 116. Fluid passing through the second inlet 122 from the middle pressure chamber 14 enters the pump 100 and "splits" into two streams. One stream passes through the second pumping section 108 and fourth pumping section 112 and exits the pump via the pump outlet 116. The other stream passes through the third pumping section 110 and enters the conduit 126 at conduit inlet 128 to combine with the fluid passed through the first pumping section 106. This enables the fluid passing through the third pumping section 110 against the "usual" flow direction (i.e. away from the outlet) to be connected to a similar vacuum point as the fluid passing through the intermediate pumping section 20 in the pump illustrated in FIG. 1. Fluid passing through a third inlet 124 from the high pressure chamber 12 may be pumped by a backing pump 150 which also backs the pump 100 via outlet 116.

A particular advantage of the embodiment described above is that, by providing two pumping sections (namely the second and third pumping sections 108, 110) on either side of the inlet to the middle chamber 14 of the differentially pumped mass spectrometer system, the mass flow rate of fluid entering the pump from the middle chamber 14 can be at least doubled in comparison to the known arrangement shown in FIG. 1, without varying the level of the vacuum in the middle chamber. Thus, the flow rate of sample and carrier gas entering the high vacuum chamber 10 from the middle chamber can also be increased, increasing the performance of the differentially pumped mass spectrometer system.

Figure 3:
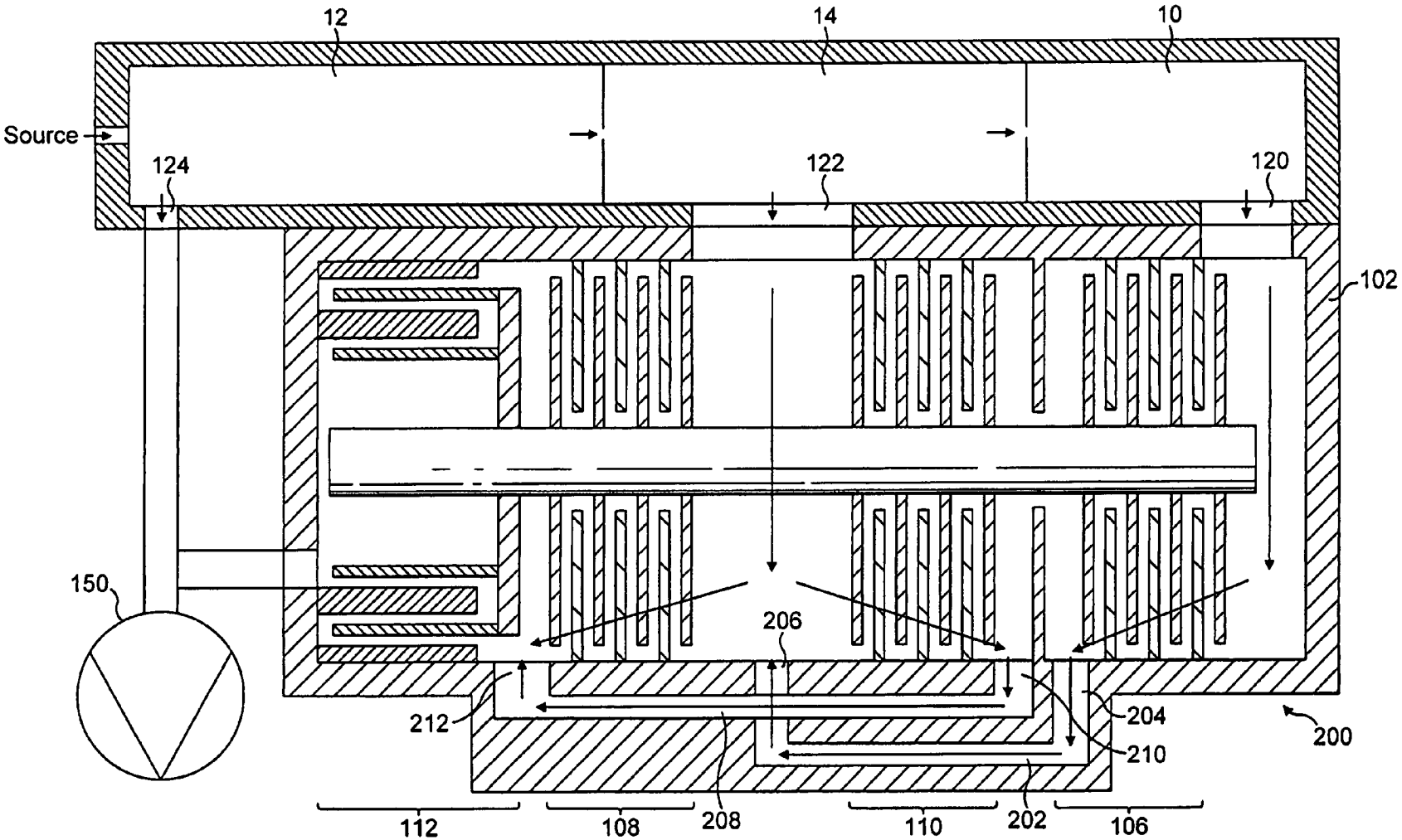
FIG. 3 is a simplified cross-section through a second embodiment of a multi port vacuum pump suitable for evacuating the differentially pumped mass spectrometer system of FIG. 1.

With reference to FIG. 3, a second embodiment of a vacuum pump 200 suitable for evacuating the high vacuum chamber 10 and intermediate chamber 14 of the differentially pumped mass spectrometer system is similar to the first embodiment, save that the conduit 126 is replaced by a first conduit 202 and a second conduit 208. The first conduit 202 has an inlet 204 located interstage the first pumping section 106 and the third pumping section 110, and an outlet 206 located interstage the second pumping section 108 and the third pumping section 110.

The second conduit 208 has an inlet 210 located interstage the first pumping section 106 and the third pumping section 110, and an outlet 212 located interstage the second pumping section 108 and the fourth pumping section 112. A baffle member 220 ensures that fluid passing through the first pumping section 106 enters the first conduit 202 and the fluid passing through the third pumping section 110 enters the second conduit 208. This arrangement can enable both the fluid passing through the third pumping section against the usual flow direction to be connected to a similar vacuum point as the fluid passing through the intermediate pumping section 20 in the pump illustrated in FIG. 1, and the fluid passing through the first pumping section to be connected to a similar vacuum point as the fluid passing through the pumping section 18 in the FIG. 1 pump.

Figure 4:
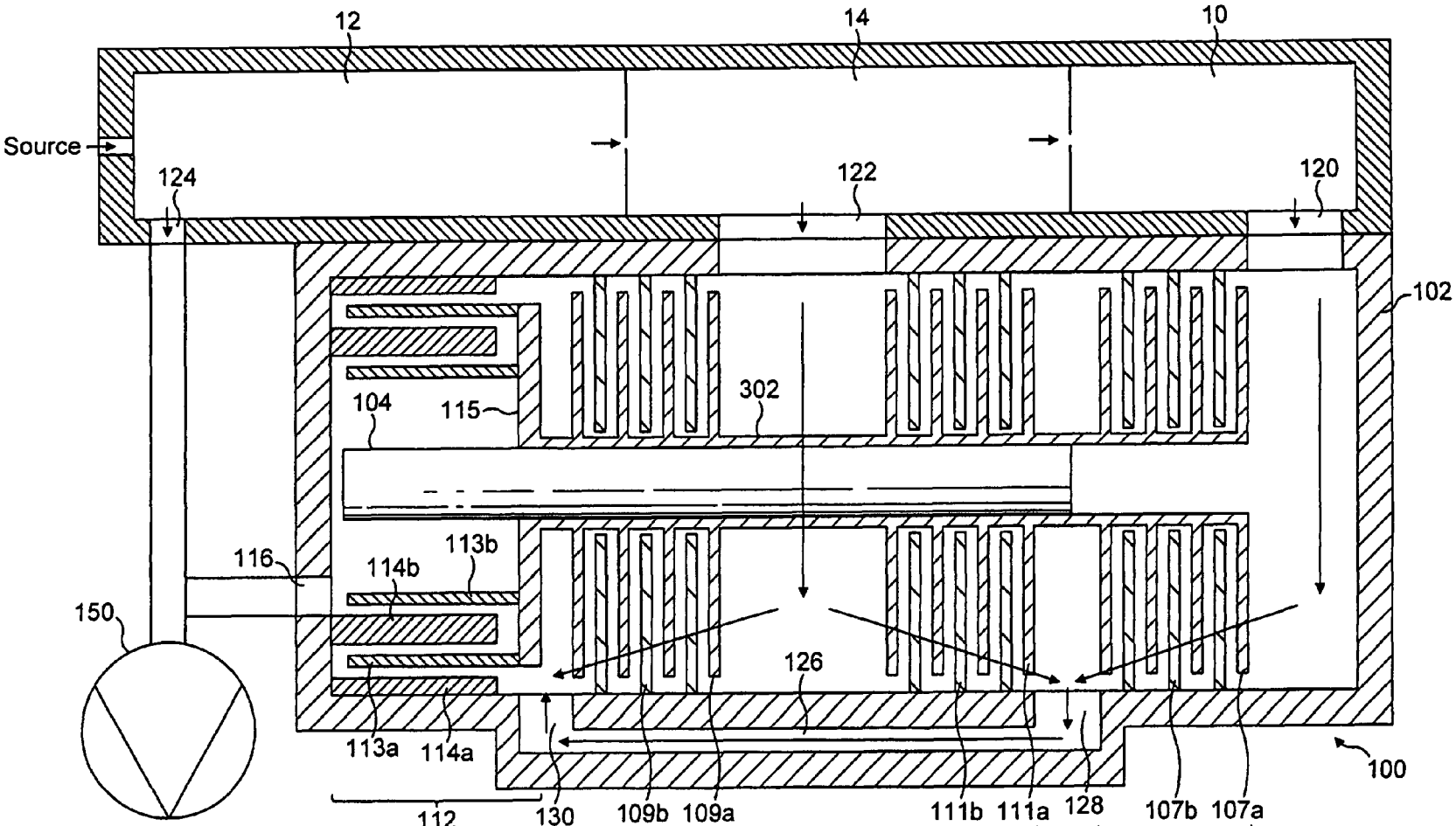
FIG. 4 is a simplified cross-section through a third embodiment of a multi port vacuum pump suitable for evacuating the differentially pumped mass spectrometer system of FIG. 1.

With reference to FIG. 4, a third embodiment of a vacuum pump 300 suitable for evacuating the high vacuum chamber 10 and intermediate chamber 14 of the differentially pumped mass spectrometer system is similar to the first embodiment, with the exception that the rotors of the various pumping sections are located on a common impeller 302. In this embodiment, the rotor blades 107*a*, 109*a* and 111*a* of the first, second and third pumping sections 106, 108 and 110 are integral with the impeller 302, and the disc 115 of the fourth pumping section 112 is also integral with the impeller 302. However, only one or more of these rotor elements may be integral with the impeller 302, with the remaining rotor elements being mounted on the drive shaft 204, as in the first embodiment, or located on another impeller, as required. The right (as shown) end of the impeller 302 may be supported by a magnetic bearing, with permanent magnets of this bearing being located on the impeller, and the left (as shown) end of the drive shaft 104 may be supported by a lubricated bearing.

I claim:

1. A vacuum pump comprising a first pumping section, a first pump inlet through which fluid can enter the pump and pass through the first pumping section towards a pump outlet, second and third pumping sections, a second pump inlet through which fluid can enter the pump, the second and third pumping sections being arranged such that fluid entering the pump through the second inlet is separated into a first stream passing through the second pumping section towards the pump outlet and a second stream passing through the third pumping section away from the pump outlet, means for conveying fluid passing through the third pumping section towards the outlet, and at least one additional pumping section downstream from the first, second and third pumping sections for receiving fluid therefrom and outputting fluid towards the outlet, wherein the second and third pumping sections are located between the first pumping section and said at least one additional pumping section.

2. The pump according to claim 1 wherein the conveying means is arranged to convey fluid passing through the third pumping section to a location intermediate the second pumping section and said at least one additional pumping section.

3. The pump according to claim 1 wherein the conveying means is arranged to convey fluid passing through the first pumping section and fluid passing through the third pumping section to a location intermediate the second pumping section and said at least one additional pumping section.

4. The pump according to claim 1 wherein the conveying means comprises a first conduit for conveying fluid passing through the first pumping section to a position intermediate the second and third pumping sections, and a second conduit for conveying fluid passing through the third pumping section to a location intermediate the second pumping section and said at least one additional pumping section.

5. The pump according to claim 4 comprising baffle means for directing fluid passing through the first pumping section to the first conduit, and for directing fluid passing through the third pumping section to the second conduit.

6. The pump according to claim 5 wherein each of the pumping sections comprises a dry pumping section.

7. The pump according to claim 6 wherein said at least one additional pumping section comprises at least one molecular drag stage.

8. The pump according to claim 7 wherein each of the first, second and third pumping sections comprises at least one turbo-molecular stage.

9. The pump according to claim 8 wherein each of the first, second and third pumping sections comprises at least three turbo-molecular stages.

10. The pump according to claim 1 comprising a drive shaft having located thereon at least one rotor element for each of the pumping sections.

11. The pump according to claim 10 wherein at least some of the rotor elements for at least the first, second and third pumping stages are integral with an impeller mounted on the drive shaft.

12. The pump according to claim 11 wherein at least one of the rotor elements of the additional pumping section comprises a cylinder mounted on the impeller.

13. The pump according to claim 12 wherein the cylinder is mounted on a disc integral with the impeller.

14. A differentially pumped vacuum system comprising two chambers and a pump according to claim 13 for evacuating each of the chambers.

15. The pump according to claim 1 wherein the conveying means is arranged to convey fluid passing through the first pumping section and fluid passing through the third pumping section to a location intermediate the second pumping section and said at least one additional pumping section.

16. The pump according to claim 15 wherein at least some of the rotor elements for at least the first, second and third pumping stages are integral with an impeller mounted on the drive shaft.

17. The pump according to claim 16 wherein at least one of the rotor elements of the additional pumping section comprises a cylinder mounted on the impeller.

18. The pump according to claim 17 wherein the cylinder is mounted on a disc integral with the impeller.

19. The pump according to claim 1 wherein the conveying means comprises a first conduit for conveying fluid passing through the first pumping section to a position intermediate the second and third pumping sections, and a second conduit for conveying fluid passing through the third pumping section to a location intermediate the second pumping section and said at least one additional pumping section.

20. The pump according to claim 19 comprising baffle means for directing fluid passing through the first pumping section to the first conduit, and for directing fluid passing through the third pumping section to the second conduit.

21. The pump according to claim 20 wherein each of the pumping sections comprises a dry pumping section.

22. The pump according to claim 21 wherein said at least one additional pumping section comprises at least one molecular drag stage.

23. The pump according to claim 22 wherein each of the first, second and third pumping sections comprises at least one turbo-molecular stage.

24. The pump according to claim 23 wherein each of the first, second and third pumping sections comprises at least three turbo-molecular stages.

25. The pump according to claim 24 comprising a drive shaft having located thereon at least one rotor element for each of the pumping sections.

26. The pump according to claim 1 wherein each of the pumping sections comprises a dry pumping section.

27. The pump according to claim 1 wherein said at least one additional pumping section comprises at least one molecular drag stage.

28. The pump according to claim 1 wherein each of the first, second and third pumping sections comprises at least one turbo-molecular stage.

29. The pump according to claim 28 wherein each of the first, second and third pumping sections comprises at least three turbo-molecular stages.

30. The pump according to claim 29 comprising a drive shaft having located thereon at least one rotor element for each of the pumping sections.

31. A differentially pumped vacuum system comprising two chambers and further comprising a pump according to claim 1 for evacuating each of the chambers.

* * * * *